US005381858A

United States Patent [19]

Fredrich

[11] Patent Number: 5,381,858

[45] Date of Patent: Jan. 17, 1995

[54] HEAT EXCHANGER AND METHOD OF MANUFACTURE

[76] Inventor: Carl Fredrich, 244 Colonial Ave., Union, N.J. 07083

[21] Appl. No.: 77,569

[22] Filed: Jun. 15, 1993

[51] Int. Cl.[6] ..... F28F 9/04

[52] U.S. Cl. ..... 165/79; 165/150; 29/890.043

[58] Field of Search ..... 165/79, 150; 29/890.043

[56] References Cited

U.S. PATENT DOCUMENTS

| | | | |
|---|---|---|---|
| 1,940,963 | 12/1933 | McIntyre | 165/150 X |
| 2,064,036 | 12/1936 | Sandberg | 165/150 X |
| 3,409,715 | 11/1968 | Schomann | 264/250 |
| 3,498,866 | 3/1970 | Kilbane | 156/285 |
| 3,633,660 | 1/1972 | Young | 165/69 |
| 3,668,757 | 6/1972 | Rieder | 72/267 X |
| 3,993,126 | 11/1976 | Taylor | 165/173 |
| 4,531,577 | 7/1985 | Humpalik et al. | 165/150 |
| 4,707,905 | 11/1987 | Clair | 29/446 |
| 4,724,903 | 2/1988 | Bayer et al. | 165/173 |
| 4,923,004 | 5/1990 | Fletcher et al. | 165/175 |
| 5,036,912 | 8/1991 | Woosnam | 165/158 |

FOREIGN PATENT DOCUMENTS

| | | | |
|---|---|---|---|
| 731431 | 6/1955 | United Kingdom | 165/79 |

*Primary Examiner*—Allen J. Flanigan

*Attorney, Agent, or Firm*—Gerald E. Hespos; Anthony J. Casella

[57] ABSTRACT

A heat exchanger is provided with a parallel array of heat exchange tubes and mounting plate assemblies on opposed ends of the tubes for achieving communication from one tube to the next. The mounting plate assembly includes an outer fitting plate stamped to define short discontinuous channels. An inner fitting plate is registered with the outer fitting plate and includes apertures, such that a pair of apertures register with each channel. A seal plate is registered with the inner fitting plate and further includes apertures registered with the apertures in the inner fitting plate. The heat exchange tubes can be inserted through the registered apertures of the seal plate and the inner fitting plate to provide communication with a channel formed in the outer fitting plate. A sealant is then injected between the inner fitting plate and the seal plate for sealing the interface between the tubes and the mounting plate assembly.

17 Claims, 3 Drawing Sheets

HEAT EXCHANGER AND METHOD OF MANUFACTURE

BACKGROUND OF THE INVENTION

1. Field of the Invention.

The subject invention relates to a heat exchanger employing stamp formed sheets to define fittings between heat exchange tubes.

2. Description of the Prior Art.

Heat exchangers are used in air conditioners, refrigerators and other such apparatus. A typical prior art heat exchanger includes an array of tubes for carrying a heat exchange fluid. Air is urged in proximity to the tubes to effect a heat exchange between the fluid in the tubes and air flowing past the tubes.

Space limitations of air conditioners, refrigerators and other such equipment requires a fairly compact array of tubes in the heat exchanger. A typical prior art heat exchanger is identified generally by the numeral 10 in FIG. 1. The prior art heat exchanger 10 includes a plurality of heat exchange tubes 12 of substantially equal length. The tubes 12 each have opposed ends 14 and 16 respectively. Thin metallic heat exchange fins 18 are mounted over the tubes 12 in substantially parallel relationship to one another and substantially orthogonally to the tubes 12. Although only three heat exchange fins 18 are depicted in FIG. 1, it is understood that the array of heat exchange fins 18 will extend substantially along the length of the respective tubes to facilitate the heat exchange process. Portions of the tubes 12 in proximity to the ends 14 and 16 are deformed to define annular beads 20 and 22 respectively at selected distances from the corresponding ends 14 and 16.

The prior art heat exchanger 10 further includes mounting plates 24 and 26. The mounting plates 24 and 26 are provided with apertures 28 and 30 which define diameters approximately equal to the diameters of the tubes 12, and smaller than the diameters defined by the respective annular beads 20 and 22. Thus, portions of tubes 12 in proximity to ends 14 are urged through apertures 28 in the mounting plate 24. Similarly, portions of the tubes 12 in proximity to the ends 16 are urged through the apertures 30 in the mounting plate 26. In this manner, the tubes can be maintained in substantially parallel relationship to one another with the ends 14 and 16 projecting selected distances from the mounting plates 24 and 26.

Assembly of the prior art heat exchanger 10 proceeds by mounting a solder ring 32 over the ends 14, 16 of tubes 12 projecting beyond the respective mounting plates 24, 26. Fittings 34, which extend through 180°, are then mounted to the respective ends 14, 16 of the tubes 12. The fittings 34 extend from one tube 12 to an adjacent tube, with the overall pattern of tube-to-fitting connections being selected to achieve a continuous flow of heat exchange fluid through all of the tubes 12 and fittings 34 of the prior art heat exchanger 10. The assembled heat exchanger is then heated sufficiently to cause the solder rings 32 to melt and wet into the region between the tubes 12 and the fittings 34 for achieving permanent connection therebetween.

Prior art heat exchangers 10 function well. However, the manufacturing process is labor intensive, time consuming and costly. In particular, the solder rings 32 must be mounted individually onto the tubes 12 by hand. Similarly, the fittings 34 extending between each of the respective tubes 12 must be manually urged into place. Improper mounting of either the solder rings 32 or the fittings 34 can result in leaks of the heat exchange fluid with corresponding negative consequences to the environment. Additionally, the heat applied to the entire apparatus may not be uniform, with the result that some solder may not completely melt or that certain portions of the heat exchanger 10 may be damaged by excessive heat.

In view of the above, it is an object of the subject invention to provide an improved heat exchanger.

It is a further object of the subject invention to provide a more efficient method of manufacturing a heat exchanger.

SUMMARY OF THE INVENTION

The subject invention is directed to a heat exchanger having a fitting plate assembly for effecting connections between heat exchange tubes in a heat exchanger. The heat exchanger of the subject invention includes a plurality of heat exchange tubes and a plurality of heat exchange fins mounted respectively over the tubes. The tubes and the fins may be substantially the same as in the prior art. However, the tubes need not be provided with the annular mounting beads that had been required in the prior art heat exchanger described and illustrated above.

Opposed ends of the heat exchange tubes are mounted respectively to mounting plate assemblies. Each mounting plate assembly may comprise an outer fitting plate, an inner fitting plate and a seal plate. The outer fitting plate may be stamped to form a plurality of short discontinuous channels. The inner fitting plate may be formed to include a plurality of apertures. The apertures through the inner fitting plate may be disposed such that a pair of apertures in the inner fitting plate register with a channel formed in the outer fitting plate. Each aperture through the inner fitting plate is dimensioned to tightly engage a tube therein. The inner and outer fitting plates may be secured in face-to-face relationship such that a pair of flanged apertures in the inner fitting plate and the channel of the outer fitting plate registered therewith will define a stamp formed fitting to effect a 180° change in direction of tubes engaged therewith.

The seal plate of the mounting plate assembly is formed to include a peripheral flange dimensioned and configured to be placed generally and register with peripheral regions of the inner fitting plate. The seal plate further is formed to include seal chambers substantially surrounding each aperture on the inner fitting plate. Each chamber formed in the seal plate includes an aperture registered with an aperture of the inner fitting plate and dimensioned to slidingly receive one said tube therein. The apertures formed in the seal plate may include tapered entries to facilitate insertion of the tubes through the apertures in the seal plate and into the apertures of the inner fitting plate. The seal plate further includes channels extending from peripheral regions of the seal plate and communicating with the chambers.

The mounting plate assemblies are assembled by initially placing the inner and outer fitting plates in face-to-face relationship with one another. In this initially assembled condition, each channel formed in the outer fitting plate will be substantially registered with a pair of apertures in the inner fitting plate. Thus, each formed channel will include one aperture defining an ingress to the channel and another aperture defining an egress from the channel. Hence, each channel and the apertures registered therewith effectively define a stamp formed 180° fitting, with the assembled inner and outer fitting plates defining a plurality of such stamp formed 180° fittings. The assembly continues by positioning the seal plate such that the chambers and the apertures thereof are substantially registered respectively with a corresponding aperture of the inner fitting plate. The aligned inner and outer fitting plates and the seal plate then are secured to one another by, for example, crimping peripheral regions or by other available metal connection methods.

The assembly continues by inserting ends of the heat exchange tubes through the registered apertures of the seal plate and the inner fitting plate. As noted above, the apertures in the seal plate and the apertures in the inner fitting plate are dimensioned to closely engage a tube inserted therein.

Manufacture proceeds by injecting a flowable sealing material into the seal channels formed between in the seal plate and the inner fitting plate. The flowable sealing material is urged through the seal channels and into the chambers surrounding the tubes inserted into the apertures of the seal plate and the inner fitting plate. The close engagement of the apertures in the seal plate and the apertures in the inner fitting plate will substantially retain the flowable sealing material in the chambers formed between the seal plate and the inner fitting plate. Hence, the tubes will be sealed to the mounting plate assembly for securely holding the tubes in the mounting plate assembly and enabling communication between adjacent tubes by means of the channels formed in the outer fitting plate. The flowable sealing material may then be cured either by exposure to heat or exposure to air.

DETAILED DESCRIPTION OF THE PREFERRED EMBODIMENT

Figure 1:
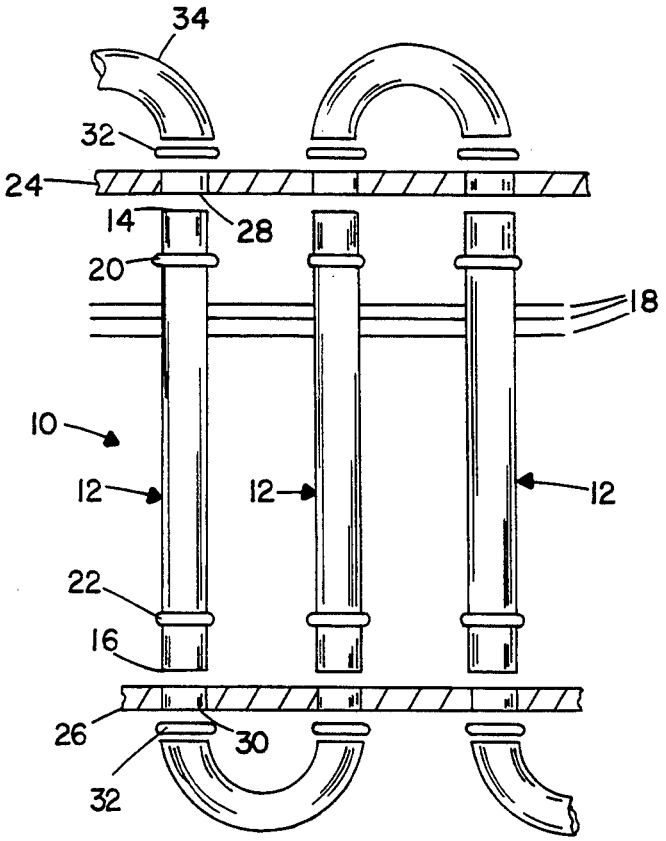
FIG. 1 (PRIOR ART)
FIG. 1 is an exploded cross-sectional view of a prior art heat exchanger.
Figure 2:
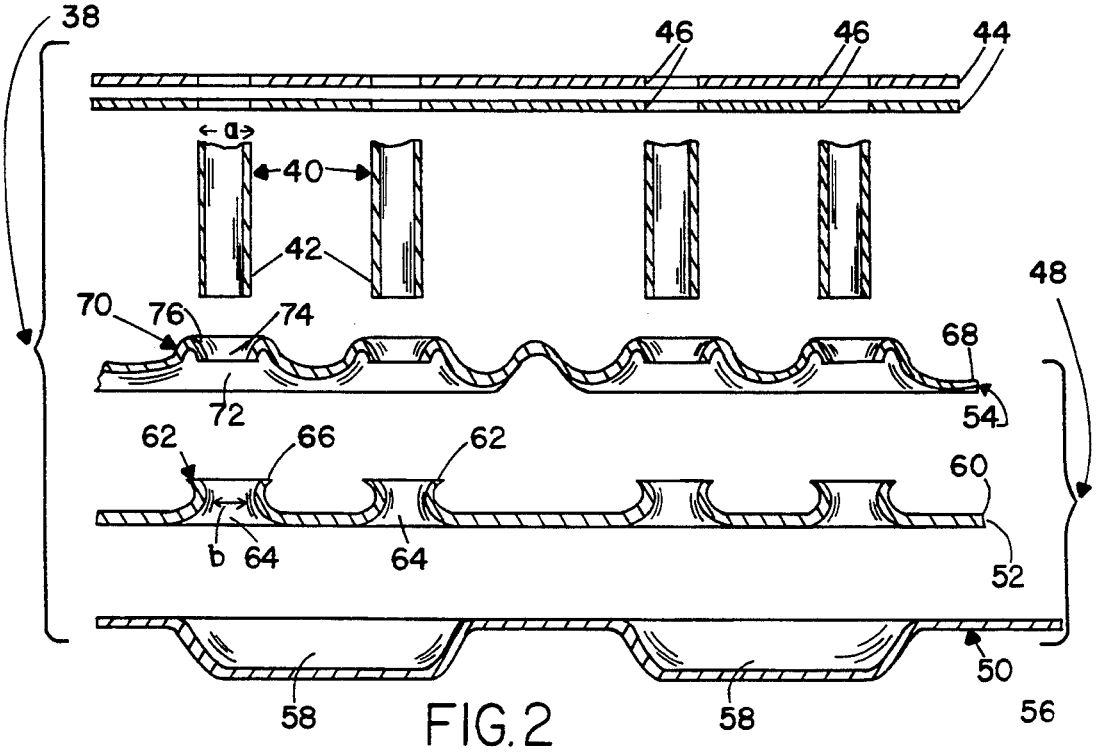
FIG. 2 is an exploded cross-sectional view of a portion of a heat exchanger in accordance with the subject invention.

A heat exchanger in accordance with the subject invention is identified generally by the numeral 38 in FIG. 2. The heat exchanger 38 includes a plurality of heat exchange tubes 40 for accommodating a flow of heat exchange fluid. Each heat exchange tube 40 includes opposed ends, one end 42 of which is depicted herein. The tubes 40 define substantially equal lengths and substantially equal outside diameters "a". The heat exchanger 40 further includes a plurality of heat transfer fins 44 having apertures 46 for receiving the tubes 40 therein. The heat transfer fins 44 are mounted to the tubes 40 in closely spaced parallel relationship to one another. Although only two heat transfer fins 44 are depicted, it is understood that a much larger number of heat transfer fins 44 will be mounted on the tubes 40 on the finished heat exchanger 38. Additionally, the schematic figures herein depict the tubes 40 and the heat exchange fins 44 as being formed from metal of approximately equal thickness. In fact, however, the typical embodiment will include heat exchange fins 44 formed from a much thinner gage of metal than the tubes 40. In still other embodiments, the heat exchange fins 44 may be formed to define a corrugated or other non-planar configuration to maximize the surface area of the heat transfer fins 44 and thereby to enhance the efficiency of the heat exchanger 38.

Figure 3:
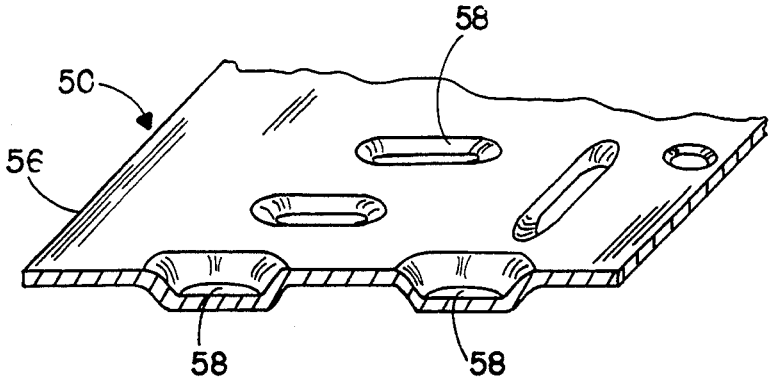
FIG. 3 is a perspective view, partly in section, of the outer fitting plate of the heat exchanger shown in FIG. 2.
Figure 4:
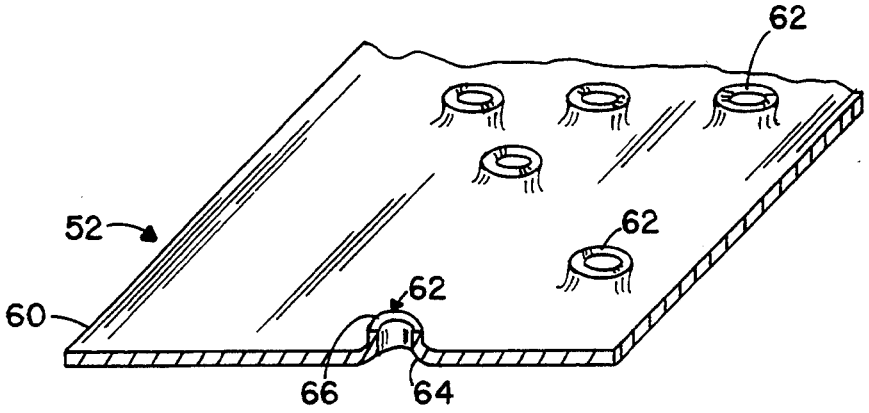
FIG. 4 is a perspective view, partly in section, of the inner fitting plate of the heat exchanger shown in FIG. 2.
Figure 5:
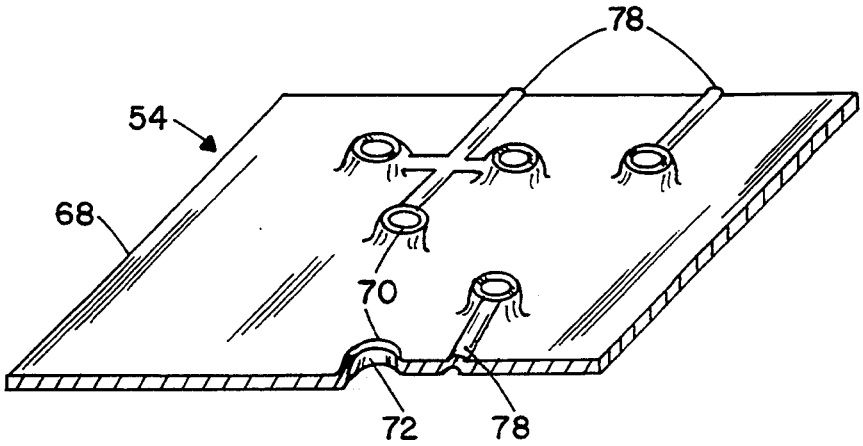
FIG. 5 is a perspective view, partly in section, of the seal plate of the heat exchanger shown in FIG. 2.

The heat exchanger 38 further includes a mounting plate assembly 48 which comprises an outer fitting plate 50, an inner fitting plate 52 and a seal plate 54. The outer fitting plate 50 is substantially planar, and includes an outer periphery 56. As shown most clearly in FIGS. 2 and 3, the outer fitting plate 50 is formed to include a plurality of short channels 58 extending from the plane thereof. The particular disposition and orientation of channels 58 is selected to conform to a preferred routing of heat exchange fluid in the heat exchanger 38.

The inner fitting plate 52 also is substantially planar and includes an outer periphery 60. However, in the embodiment depicted herein, the inner and outer fitting plates 50 and 52 do not include registrable peripheries 56 and 60. Thus, in the illustrated embodiment, the larger periphery defined by the outer fitting plate 50 enables a crimped engagement of peripheral regions 60 of the outer fitting plate 50 with adjacent regions of the inner fitting plate 52 and the seal plate 54 as explained further herein. The inner fitting plate 52 further is characterized by a plurality of generally annular flanges 62 projecting from the plane of the inner fitting plate 52. More particularly, the inner fitting plate 52 is oriented such that the flanges 62 project away from the outer fitting plate 50. The flanges 62 each surround apertures 64 which define minor diameters "b" approximately equal to the diameters "a" of the tubes 40. The minor diameters "b" of the apertures 64 defined by the flanges 62 are intermediate the axial length of each annular flange 62. Thus, each annular flange 58 effectively defines a flared entry 66 at regions thereon remote from the planar portion of the inner fitting plate 52.

The seal plate 54 includes peripheral regions 68 disposed to register with peripheral region 60 of the inner fitting plate 52. The seal plate is further formed to define generally hemispherical shells 70 registrable respectively with the annular flanges 62 of the inner fitting plate 52. Each shell 70 defines a sealant chamber 72. Each shell 70 further includes a central aperture 74 defining a diameter "c" which is approximately equal to the minor diameter "b" defined by the annular flanges 62 of the inner fitting plate 52, and hence approximately equal to the outside diameter "a" of each tube 40. The shells 70 are formed to define tapered entries 76 leading into each aperture 74.

Figure 6:
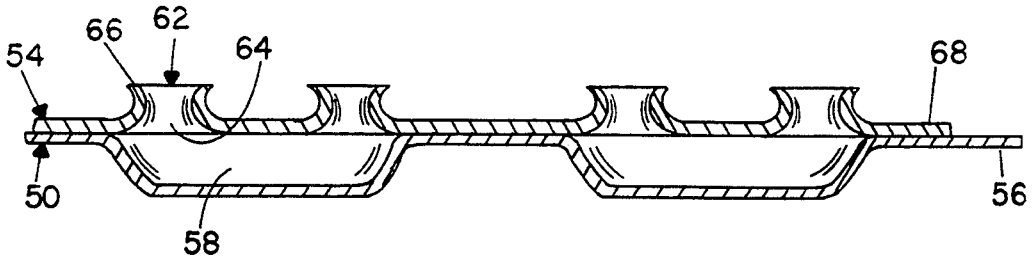
FIG. 6 is a cross-sectional view showing the inner and outer fitting plates in an assembled condition.
Figure 7:
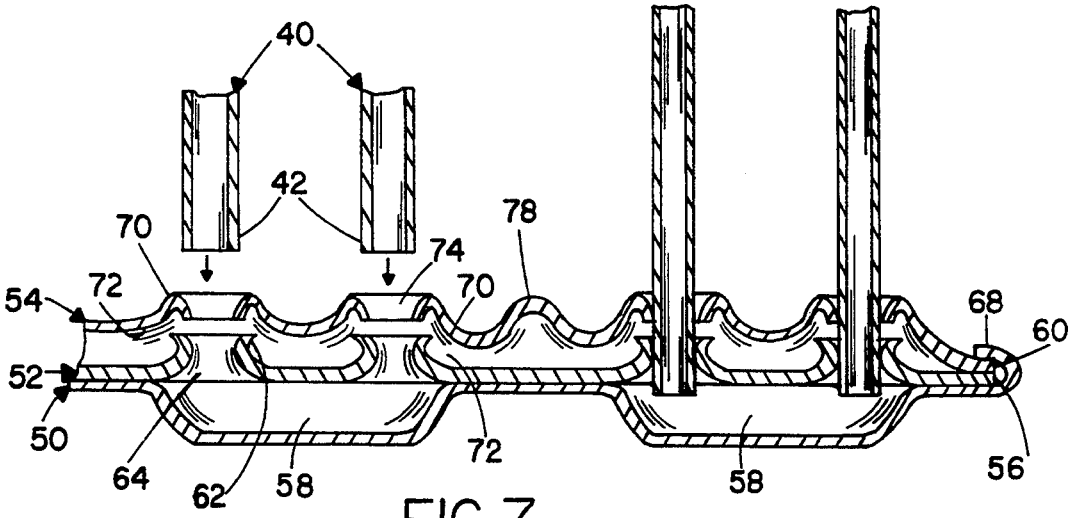
FIG. 7 is a cross-sectional view similar to FIG. 6 and showing the inner and outer fitting plates and the seal plate assembled together.

The mounting plate assembly 48 is assembled as shown in FIGS. 6 and 7. More particularly, the outer and inner fitting plates 50 and 52 are disposed in face-to-face relationship such that each channel 58 in an outer fitting plate is registered with a pair of flanges 62 defined by the inner fitting plate 52. As shown in FIG. 6, the peripheral regions 60 of the inner fitting plate 52 are spaced inwardly from peripheral regions 56 of the outer fitting plate 50.

Assembly proceeds by positioning seal plate 54 such that peripheral regions 68 thereof are substantially registered with peripheral region 60 of the inner fitting plate 54, and such that the respective apertures 74 of the inner seal plate are registered with the apertures 64 passing centrally through the annular flanges 62 of the inner fitting plate 52. The outer and inner fitting plates 50 and 52 and the seal plate 54 are then secured in this position by crimping peripheral regions 56 of the outer fitting plate 50 into engagement with peripheral regions 60 and 68 of the inner fitting plate 52 and the seal plate 54 respectively. The heat exchange tubes 42 are then slidably inserted respectively through the apertures 74 of the seal plate 54 and through the apertures 64 of the inner fitting plate 52. As noted above, the relative diametrical dimensions of the heat exchange tubes 42 and the apertures 74 and 64 ensure a close fit. Thus, as illustrated most clearly in the right hand portion of FIG. 7, the heat exchange tubes 42 communicate with one another through the stamp formed fitting defined by the channel 58 in the outer fitting plate 50 and portions of the inner plate 52 registered therewith.

Figure 8:
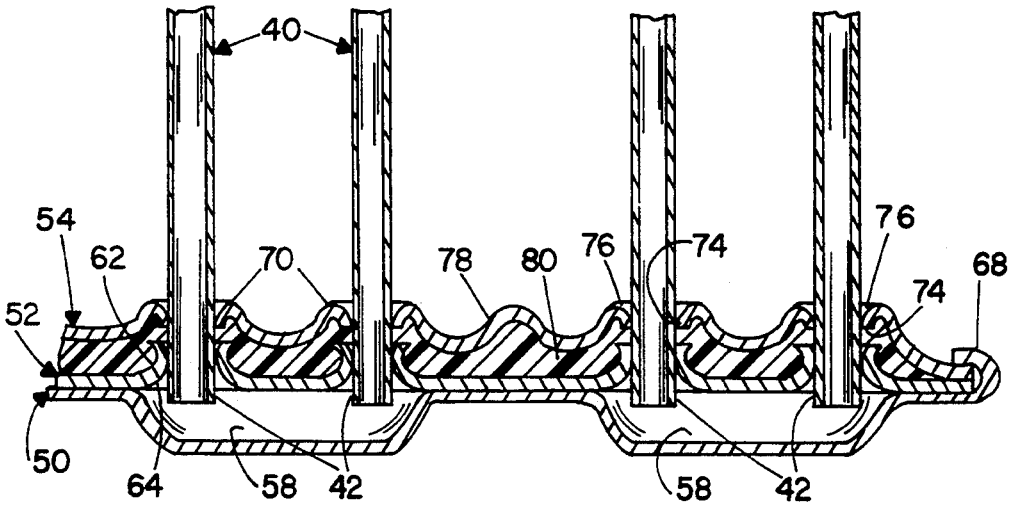
FIG. 8 is a cross-sectional view similar to FIGS. 6 and 7 showing a portion of the completed heat exchanger.

Leakage of heat exchange fluid can affect the efficiency of the heat exchanger, and may be environmentally undesirable. As a result, the seal plate 54 is provided with sealant channels 78 which extend from the periphery 68 to the chambers 72. A sealant 80 is inserted between the inner fitting plate 52 and the seal plate 54. More particularly, an initially flowable sealant 80 is urged through the seal channels 78, and to the chambers 72 surrounding each heat exchange tube 40. The sealant may be an elastomer, such as silicon, which is initially flowable, but which subsequently cures into a non-flowable condition. In this regard, the primary functions for positioning and retaining the heat exchange tubes are performed by the walls of the inner fitting plate 52 and the seal plate 54. The sealant 80 performs primarily a sealing function, and a less significant function in terms of positioning and holding the heat exchange tubes 40. Although an elastomer is shown in FIG. 8, metallic alloys that are initially flowable and subsequently hardenable may also be employed.

Assembly of the heat exchanger 40 proceeds by slidingly positioning the heat transfer fins 44 over the heat exchange tubes 42. A second mounting plate assembly 38 may then be secured to the opposed ends of the tubes 40 and sealed as described above.

While the invention has been described with respect to a preferred embodiment, it is apparent that various changes can be made without departing from the scope of the invention as defined by the appended claims. In particular, means other than crimping may be employed to secure the components of the mounting plate assembly together. Similarly, the person skilled in the art will appreciate the range of alternate sealants that may be used.

I claim:

1. A heat exchanger comprising a plurality of tubes for carrying a heat exchange fluid and a mounting plate assembly for providing communication between pairs of said tubes, said mounting plate assembly comprising:

an inner fitting plate having a plurality of apertures mounted respectively to the tubes;

an outer fitting plate disposed in substantially face-to-face relationship with the inner fitting plate and being formed to define a plurality of channels, each said channel being dimensioned and disposed to register with a pair of said apertures in the inner fitting plate, such that said channels provide communication between the tubes engaged with the apertures registered with each said channel;

a seal plate disposed in opposed relationship to said inner fitting plate and being formed to include a plurality of apertures engaged respectively over the tubes, said seal plate further being formed to define at least one shell substantially surrounding the respective tubes engaged in the apertures of said seal plate and said inner fitting plate, said shell defining at least one sealant chamber surrounding portions of the tubes between the seal plate and the inner fitting plate; and a sealing material disposed in the chamber defined by the seal plate and in sealing engagement with portions of said tubes intermediate the seal plate and the inner fitting plate.

2. A heat exchanger as in claim 1, wherein the inner fitting plate further includes generally annular flanges projecting toward said seal plate and surrounding the respective apertures formed in the inner fitting plate, said flanges being dimensioned to securely engage the respective tubes.

3. A heat exchanger as in claim 1, wherein the mounting plate assembly is further formed to define sealant channels between the seal plate and the inner fitting plate, said seal injection channels extending from peripheral regions of the mounting plate assembly to the chamber for enabling injection of the sealant.

4. A heat exchange assembly as in claim 1, wherein the seal plate includes tapered entries to the respective apertures of the seal plate for efficiently inserting the tubes.

5. A heat exchanger as in claim 1, wherein the sealant is an elastomer.

6. A heat exchanger as in claim 1, wherein the inner and outer fitting plates and the seal plate are secured in face-to-face relationship to one another by crimped engagement at peripheral regions thereof.

7. A heat exchanger as in claim 6, wherein the outer fitting plate is larger than the inner fitting plate and the seal plate, peripheral regions of the outer fitting plate being crimped into engagement with the inner fitting plate and the seal plate.

8. A heat exchanger as in claim 1, wherein at least one shell comprises a plurality of shells and a corresponding plurality of chambers, said shells being disposed to surround portions of the respective tubes projecting from the inner fitting plate.

9. A heat exchanger comprising a plurality of tubes for carrying a heat exchange fluid and a mounting plate assembly for providing communication between pairs of said tubes, said mounting plate assembly comprising:

an inner fitting plate having a plurality of apertures extending therethrough and a plurality of annular flanges projecting therefrom and surrounding the respective apertures, each said annular flange being dimensioned to tightly receive a portion of one said tube therein;

an outer fitting plate disposed substantially in face-to-face relationship with the inner fitting plate, said outer fitting plate being formed to define a plurality of channels, each said channel being dimensioned and disposed to register with a pair of said apertures in the inner fitting plate, such that said channels and portions of said inner fitting plate registered therewith provide communication between a pair of said tubes engaged in said apertures of the inner fitting plate;

a seal plate disposed in substantially face-to-face relationship with a side of said inner fitting plate opposite said outer fitting plate, said seal plate being formed to include a plurality of apertures engaged respectively over the tubes, and being formed to define a plurality of shells surrounding the respective apertures, each said shell defining a chamber surrounding portions of one said tube between the inner fitting plate and the seal plate, and channels being formed between the seal plate and the inner fitting plate, said channels extending from each said chamber to peripheral regions of the mounting plate assembly; and a sealing material disposed in the respective chambers and the channels between the seal plate and the inner fitting plate for sealingly engaging portions of the tubes between the seal plate and the inner fitting plate.

10. A method for manufacturing a heat exchanger, said method comprising:

forming an inner seal plate to include a plurality of apertures dimensioned for tightly engaging said tubes;

forming an outer fitting plate with a plurality of channels, each said channel being disposed and dimensioned for registration with a pair of said apertures formed in said inner fitting plate;

forming a seal plate to include chambers dimensioned and disposed to surround the respective apertures in the inner fitting plate, said seal plate further being formed to include apertures dimensioned to engage the tubes and disposed to register with the respective apertures in the inner fitting plate;

securing the outer fitting plate and the seal plate on opposed respective sides of said inner fitting plate, such that each said channel in the outer fitting plate registers with a pair of apertures in the inner fitting plate, and such that each said chamber and each said aperture in the seal plate registered with a corresponding aperture in the inner fitting plate;

urging the respective tubes through the apertures of the seal plate and the inner fitting plate, such that each said tube communicates with one said channel of said outer fitting plate;

injecting a sealing material into the chambers for surrounding and sealing portions of said tubes engaged between said seal plate and said inner fitting plate.

11. A method as in claim 10, wherein the step of forming said seal plate further comprises forming channels in said seal plate communicating with the respective chambers formed in the seal plate, and wherein the step of injecting a sealing material into said chambers comprises injecting the sealing material through the channels and into the chambers.

12. A method as in claim 10, wherein the sealing material is an elastomeric material.

13. A method as in claim 12, wherein the sealing material is silicon.

14. A method as in claim 10, wherein the step of securing the inner and outer fitting plates and the seal plate together comprises crimping the plate in face-to-face engagement with one another.

15. A method as in claim 14, wherein the outer fitting plate is larger than the inner fitting plate and the seal plate, and wherein the crimping comprises crimping peripheral regions of said outer fitting plate to peripheral regions of said seal plate and said inner fitting plate.

16. A method as in claim 10, wherein the step of forming the chambers and the apertures in the seal plate comprises forming tapered entries to each said aperture for facilitating insertion of said tubes into said apertures of said seal plate.

17. A method as in claim 10, wherein the step of forming the apertures in the inner fitting plate comprises forming generally annular flanges, said apertures of the inner seal plate being disposed centrally within the flanges.

* * * * *